US007604290B1

(12) United States Patent
Giordano

(10) Patent No.: US 7,604,290 B1
(45) Date of Patent: Oct. 20, 2009

(54) COOLER BENCH SEAT

(76) Inventor: Robert Giordano, 10 Park Pl., Williston Park, NY (US) 11596

( * ) Notice: Subject to any disclaimer, the term of this patent is extended or adjusted under 35 U.S.C. 154(b) by 0 days.

(21) Appl. No.: 12/028,358

(22) Filed: Feb. 8, 2008

(51) Int. Cl.
*A47C 7/62* (2006.01)

(52) U.S. Cl. ..... 297/188.1; 297/188.09; 220/915.2

(58) Field of Classification Search ..... 297/188.1, 297/188.09, 188.08, 188.11; 220/23.86, 220/592.2, 592.03, 915.2, 915.1, 628, 629, 220/475; 62/457.7
See application file for complete search history.

(56) References Cited

U.S. PATENT DOCUMENTS

| | | | | |
|---|---|---|---|---|
| 2,812,227 | A | 11/1957 | Hill | |
| 4,474,407 | A | 10/1984 | Nazar | |
| 5,050,767 | A | 9/1991 | Peer | |
| 5,100,198 | A | 3/1992 | Baltzell | |
| 5,527,091 | A * | 6/1996 | Gruber | 297/188.01 |
| 5,660,296 | A * | 8/1997 | Greenwich | 220/326 |
| 5,722,717 | A * | 3/1998 | Rettenberger | 297/188.1 |
| 5,727,844 | A * | 3/1998 | O'Quinn et al. | 297/217.1 |
| 5,938,281 | A * | 8/1999 | Keils | 297/217.1 |
| 6,000,752 | A * | 12/1999 | Shyr | 297/188.08 |
| 6,341,817 | B1 | 1/2002 | Stern-Gonzalez | |
| 7,309,106 | B2 * | 12/2007 | Stallman | 297/310 |
| 7,341,164 | B2 * | 3/2008 | Barquist et al. | 220/629 |
| 2006/0261654 | A1 | 11/2006 | Stallman | |

FOREIGN PATENT DOCUMENTS

| | | |
|---|---|---|
| AU | 2003100682 | 12/2003 |
| CA | 2.587.933 | 6/2006 |
| JP | 2005329962 | 12/2005 |

* cited by examiner

*Primary Examiner*—David Dunn
*Assistant Examiner*—Erika Garrett
(74) *Attorney, Agent, or Firm*—Michael I Kroll

(57) ABSTRACT

A cooler whereby a user may store cold stored commodities while additionally serving as a location whereby one or more users may sit upon like a bench. The present invention provides seating by a combination of provided padding on its top surface, a telescopic back rest that folds up or down to provide back support and extendable legs to raise and lower the device to a suitable height whereby a user may comfortably sit upon.

12 Claims, 11 Drawing Sheets

COOLER BENCH SEAT

BACKGROUND OF THE INVENTION

1. Field of the Invention

The present invention relates generally to coolers and, more specifically, to a cooler having a padded cushion attached to its top, a telescopic back rest and retractable legs that when deployed and utilized together form a place to sit or bench. The cooler bench seat is comprised of a housing having a cooler portion with a hinged lid covered by a padding forming the cooler-bench seat portion, a telescopically extendable retractable back-rest portion forming the cooler-bench seat-back portion and extendable retractable legs to raise the cooler to a more suitable sitting height. Additionally on the opposing ends of the cooler body a plastic pocket for a teams logo or indicia is supplied for display there through.

2. Description of the Prior Art

There are other cooler devices designed for sitting on top of. Typical of these is U.S. Pat. No. 2,812,227 issued to Hill on Nov. 5, 1957.

Another patent was issued to Nazar. on Oct. 2, 1984 as U.S. Pat. No. 4,474,407. Yet another U.S. Pat. No. 5,050,767 was issued to Peer on Sep. 24, 1991 and still yet another was issued on Mar. 31, 1992 to Baltzell as U.S. Pat. No. 5,100,198.

Another patent was issued to Greenwich on Aug. 26, 1997 as U.S. Pat. No. 5,660,296. Yet another U.S. Pat. No. 5,727,844 was issued to O'Quinn et al. on Mar. 17, 1998. Another was issued to Shyr on Dec. 14, 1999 as U.S. Pat. No. 6,000,752 and still yet another was issued on Jan. 29, 2002 to Stem-Gonzalez as U.S. Pat. No. 6,341,817.

Another patent was issued to McLure on Nov. 3, 2003 as Australian Patent No. 2003100682. Yet another Japanese Patent No. JP2005329962 was issued to Minoru on Dec. 2, 2005. Another was issued to Ward on Nov. 23, 2005 as Canadian Patent No. CA2587933 and still yet another was issued on Nov. 23, 2006 to Stallman as U.S. Patent Application No. 2006/0261654.

U.S. Pat. No. 2,812,227

Inventor: A. Hill

Issued: Nov. 5, 1957

A combined hassock and bar comprising a hollow body, said body being formed open at its top and at least at one side thereof, lid means normally closing the top of said body, door means normally closing said side of the body, a tray mounted for vertical sliding movement within the body, the means normally shifting said tray upwardly within the body said lid means including a pair of padded lids hinged to the body at opposite ends thereof said tray including a plurality of recesses for receiving glasses and like articles the body including a flat bottom plate having a plurality of recesses for receiving bottles or the like, said tray having a series of apertures vertically aligned, with the recesses in the bottom plate for engaging the necks of said bottles in the lowered position of the tray.

U.S. Pat. No. 4,474,407

Inventor: Robert C. Nazar

Issued: Oct. 2, 1984

There is disclosed an ingenious portable foldable chair, constructed of moulded plastic or the like, provided with a seat having therein a hollow thermally insulated compartment. Said compartment may be lined and may be provided with a locking seat compartment access panel or door which provides sealing of said compartment and access to perishable foodstuffs, canned or bottled beverages, ice, fishing bait, or the like.

U.S. Pat. No. 5,050,767

Inventor: Daniel Peer

Issued: Sep. 24, 1991

A portable container device, particularly adapted for use by spectators in bleachers seats, is disclosed. The device comprises a container having a bottom, a top and four sides and a support bracket secured to the top of the container. The support bracket comprises upper and lower flanges adapted to be positioned above and below a bleacher seat. A depth flange is connected to and between the upper and lower flanges and serves to maintain them in substantially parallel relationship. The depth flange is located above the front wall, on the front side of the device. A pivotable support handle may be provided adjacent to the rear side of the device so that it can be pivoted between a rest position and a support position. In the support position, the handle supports the upper flange to maintain it in substantially parallel relationship to the lower flange, even for example, when a person is seated upon the upper flange. A cushioned seat may be provided on the top of the upper flange for comfort.

U.S. Pat. No. 5,100,198

Inventor: Ricky L. Baltzell

Issued: Mar. 31, 1992

A seat cooler apparatus is set forth including a cushion seat member removably mounted relative to an underlying cabinet, wherein the cabinet includes a cooler chest defined by an extensible and retractable drawer container within the cabinet. A modification of the invention includes an extensible cushion member overlying the drawer, and further including retractable wheels mounted to side walls of each cabinet for portability of the organization.

U.S. Pat. No. 5,660,296

Inventor: Ryan E. Greenwich

Issued: Aug. 26, 1997

A mobile cooler includes a container that is partitioned to form a cold compartment and a non-cooled compartment. A cover is removably mounted on the container to overlie both compartments. In one position, the cover can function as a small chair. In an alternate position the cover is held close against the container to facilitate compact storage of the cooler in a minimum space, and easy towing of the cooler from one place to another place.

U.S. Pat. No. 5,727,844

Inventor: Jeffrey Lee O'Quinn

Issued: Mar. 17, 1998

A cooler and seat system including an insulated container that has a rectangular bottom member with a rectangular rear wall, a rectangular front wall and a pair of side walls. The insulated container has an upper peripheral edge therearound and integral the walls. A first lid has a bottom portion and a top portion with a peripheral wall therebetween and hingedly coupled to the rear wall of the insulated container. A second lid has a bottom portion and a top portion with a peripheral wall therebetween. The peripheral wall is hingedly coupled to the peripheral wall of the first lid for selective rotation of the second lid thereabout. The first lid, when coupled with the second lid, is capable of forming a seat. Lastly, a pair of anti-extension straps with each having a first end coupled to the first lid and a second end coupled to the second lid.

U.S. Pat. No. 6,000,752

Inventor: Michael H. Shyr

Issued: Dec. 14, 1999

A portable seat including a receptacle attached below the textile material that comprises a seat plane. The receptacle is a larger storage space than previously offered due to a set of the protrusions located on the leg assemblies that enable the foldable backrest to achieve an operative position for sitting without encroaching upon receptacle space. The zippers extending to three sides of the receptacle also provides greater access to the inside of the receptacle.

U.S. Pat. No. 6,341,817

Inventor: Edgar Stem-Gonzalez

Issued: Jan. 29, 2002

A cooler is provided with an integrated seat and a reclinable seat back formed by one cover used to close the cooler. Drinks and foods may be stored and maintain fresh and cool in the cooler. On top of the cover, a second cover is provided, which becomes the upper cover of a conventional cooler. The first cover that is used to close the cooler serves also as the seat when closed. The upper or second cover of the cooler serves as the seat back when opened at a 90 degree angle or higher. Two leashes, one on each side, maintain the seat back in the desired position. Such seat back can vary from 0 to 180 degrees. When opened at a greater angle than 130 degrees, the seat back is supported by a pair of legs located on the external surface of the second cover of the cooler, attached by one of their ends to such cover but free on the other end and attached only by pressure to such cover. The legs are capable of opening to a 90 degree angle with respect to their original position. A cushion may be placed on top of the seat and against the seat back so the cooler may have a cushioned seat and reclinable seat back for better comfort. The movement of the two covers are triggered by two pairs of hinges, each pair being independent from one another.

Australian Patent Number AU2003100682

Inventor: James McLure

Issued: Dec. 12, 2003

The disclosed "portable cooler seat" is a rectangular shaped cooling unit which turns into a seat once the back rest extension has been pulled out. The hatch which can be opened 5 is padded to add comfort while sitting and is opened by interlocking the associated lock 7.

Japanese Patent Number JP2005329962

Inventor: Minoru Miyamoto

Issued: Dec. 2, 2005

PROBLEM TO BE SOLVED: To improve convenience by making putting in and out to a cooler box possible as one remains to take a seat thereon even when it is used as a seat during fishing or the like, and to improve ease-of-use by facilitating to take out a stored article of the lower side even when a lot of the stored articles are stored under a piled condition in the cooler box. SOLUTION: For the constitution of cooler boxes 1a and 1b which have a box main body part 2 with an opening part Pf opened upward, and a lid part 3 openably and closeably provided on the opening part Pf through hinge parts 4 . . . , an auxiliary opening part Ps opened sideways is provided on the side face part 2s of the box main body part 2, and an openable and closeable side door part 5 is provided on this auxiliary opening part Ps through hinge parts 6.

Canadian Patent Number CA2587933

Inventor: Jerry Ward

Issued: Nov. 23, 2005

A cooler having an integrated seat assembly, includes a cooler body which can have one or more compartments. The cooler body is coupled with a seat assembly bracket by a coupling means, such as a hinge. Seat backs are integrally formed in one sidewall of the cooler body and seat bottoms are formed on the bracket, such that when the bracket is opened, it forms a seat with the seat backs. The bracket can be folded up flat against the cooler in a closed and locked position, for easy storage or transportation.

U.S. Patent Application Number 2006/0261654

Inventor: James J. Stallman

Issued: Nov. 23, 2006

A combined cooler/seat having an anti-tip support that extends rearward the ground contact of the cooler/seat beyond the simple footprint of the cooler/seat itself, thereby providing extra support for resisting backward tilting of the cooler/seat; wherein the anti-tip support adjustably extends rearward from the bottom rear portion of the cooler/seat.

While these coolers may be suitable for the purposes for which they were designed, they would not be as suitable for the purposes of the present invention, as hereinafter described.

SUMMARY OF THE PRESENT INVENTION

A primary object of the present invention is to provide a cooler whereby a user may easily set up the device to act both fully as a bench and cooler.

Another object of the present invention is to provide a cooler having a back rest portion stemming from its back to provide the backing of a seat for use while sitting on the cooler of the present invention.

Yet another object of the present invention is to provide a cooler having retractable legs for the setting, raising and lowering of the cooler of the present invention above the ground at an appropriate sitting height.

Still yet another object of the present invention is to provide a cooler having a handle for aiding in the transportation of the device from location to location.

Another object of the present invention is to provide a cooler having an area for displaying and containing an article with indicia or a logo for display.

Yet another object of the present invention is to provide a cooler whereby the user may easily transport the device from location to location and set up and arrangement whereby a user may comfortably sit upon the device.

Additional objects of the present invention will appear as the description proceeds.

The present invention overcomes the shortcomings of the prior art by providing a cooler for the storage of cold-stored commodities while additionally serving as a location for one or more users to sit upon like a bench. The present invention provides seating by a combination of provided padding on its top surface, a telescopic back rest movable up or down to provide back support and extendable legs to raise and lower the device to a suitable height whereby a user may comfortably sit upon. Additionally the present invention provides one or more exterior display pockets for inserting and exhibiting ads, names or logos to the public from therewithin.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
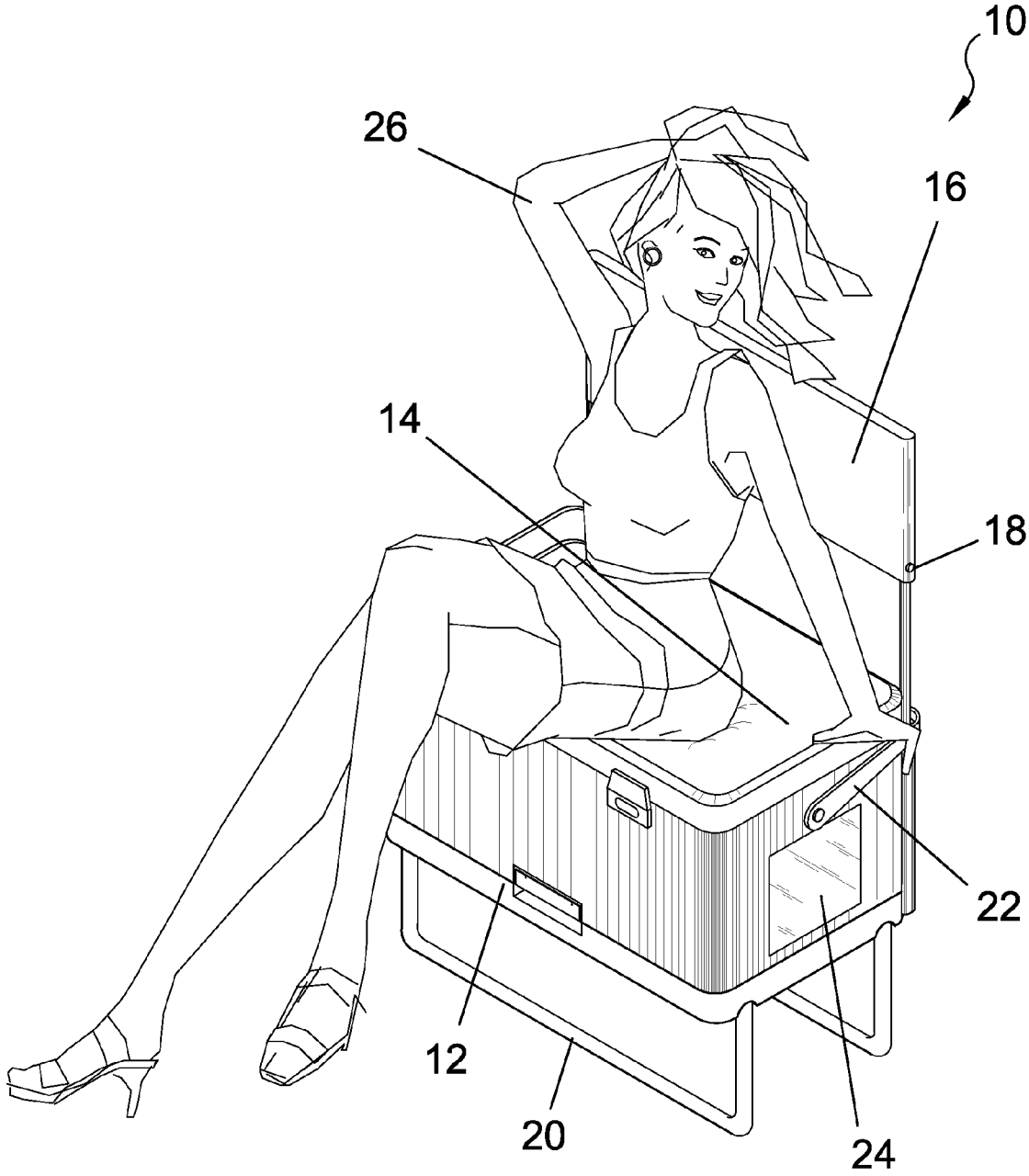
FIG. 1 is an illustrative view of the present invention in use.

Turning now descriptively to the drawings, in which similar reference characters denote similar elements throughout the several views, the figures illustrate the Portable Cooler Bench Seat of the present invention. With regard to the reference numerals used, the following numbering is used throughout the various drawing figures.

10 Portable Cooler Bench Seat of the present invention
12 cooler body
14 padded cover seat
16 back support
18 lock of 16
20 extendible/retractable leg
22 locking swivel handle
24 plastic pocket
26 user
28 cover access lock
32 release latch of 20
34 housing of 16
36 interior of 12
38 sidewall of 12
40 pivot point connection of 22
42 lock button of 22
44 telescoping arm of 16
46 arm release button
48 back support release button
50 base of 12
52 release assembly of 20
54 recessed leg channel
56 pulley
58 cable
60 locking pin
62 tension spring
64 locking aperture of 20

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. The present invention 10 is cooler bench seat comprising a cooler body 12 having a padded cover 14 that serves as a seat with a telescoping back support 16 with a lock 18 for preventing casual displacement once extended or retracted. The cooler body 12 has legs 20 that extend from the body 12 for supporting a load while in use and are retractable for storage. A locking swivel handle 22 is provided for portability. Pockets 24 are positioned on each side for placement of a placard of a team logo or other user provided graphic. Shown is the user 26 seated on the padded cooler cover seat 14.

Figure 2:
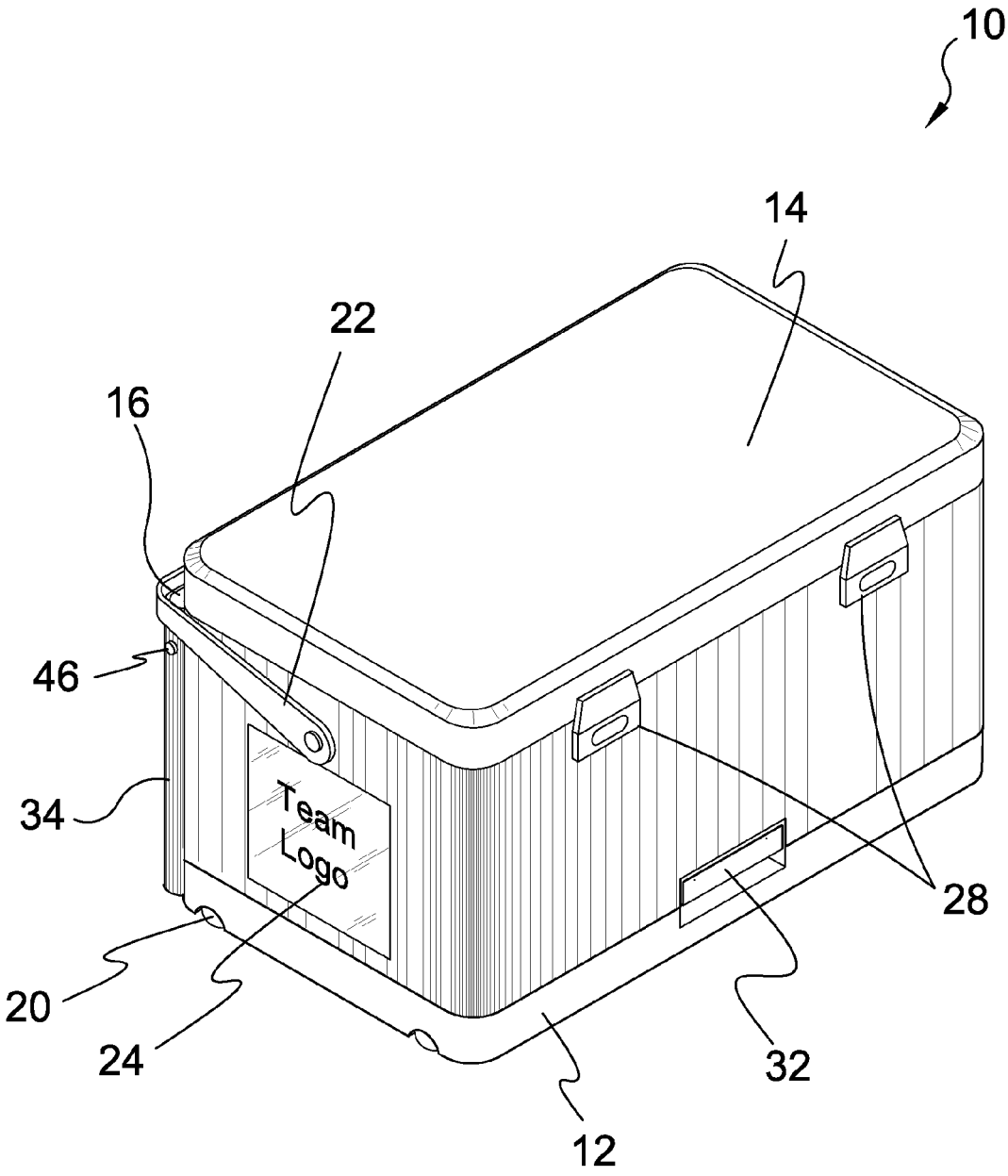
FIG. 2 is a frontal perspective view of the present invention.

FIG. 2 is a frontal perspective view of the present invention 10. Shown is the cooler bench seat 10 with the cooler cover seat 14 closed and secured with access locks 28. A release latch 32 controls the locking mechanism for the retractable legs 20. The swivel handle 22 is in the down position and a release button 46 enables the user to selectively raise the back support 16 from its housing 34 located at the rear of the cooler body 12.

Figure 3:
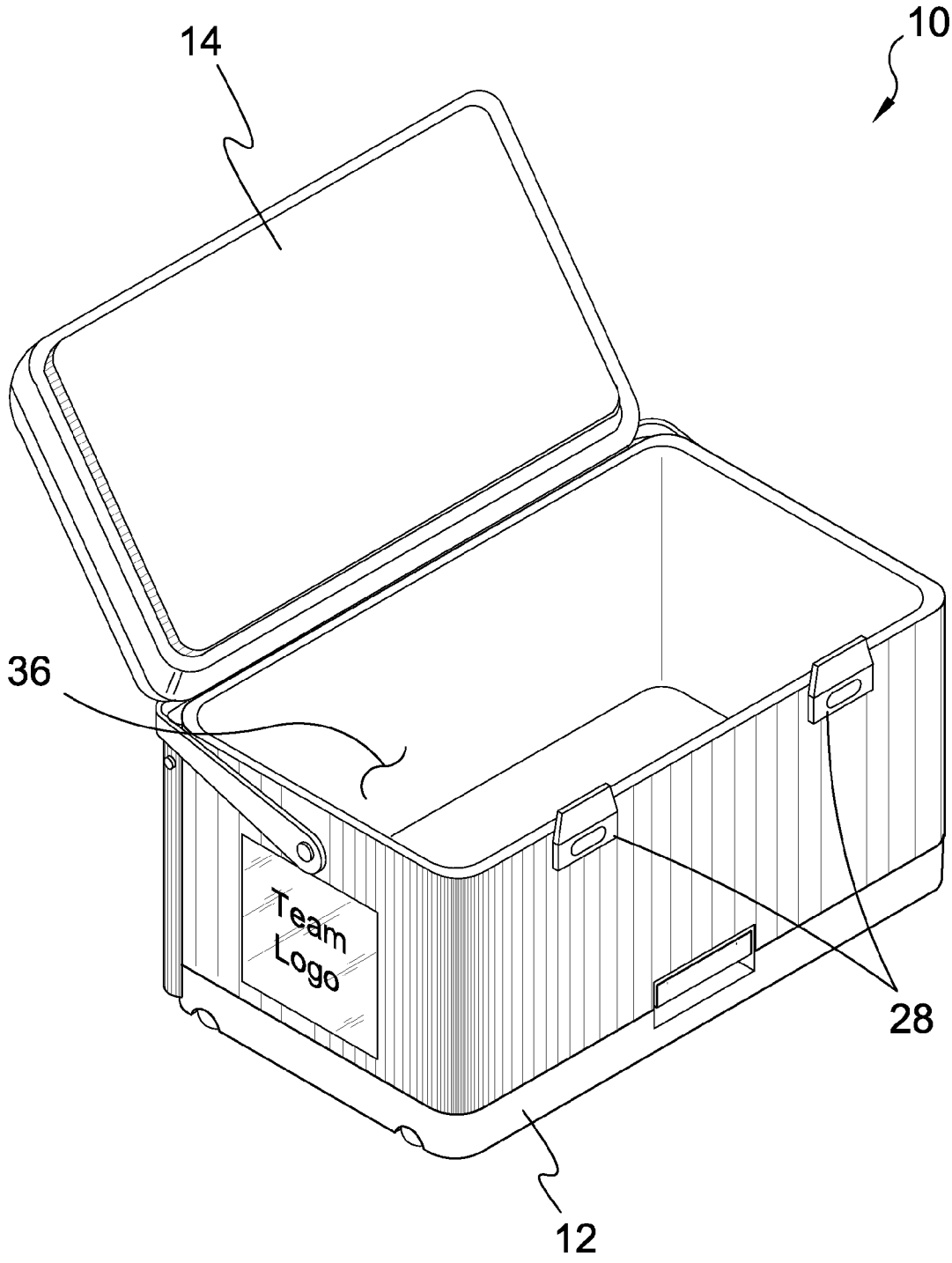
FIG. 3 is a perspective view of the present invention.

FIG. 3 is a perspective view of the present invention 10. Shown is the cooler body 12 with the padded cooler cover seat 14 released from the cover access locks 28 and in the open position to reveal the interior 36. The swivel handle 22 is in the lowered position.

Figure 4:
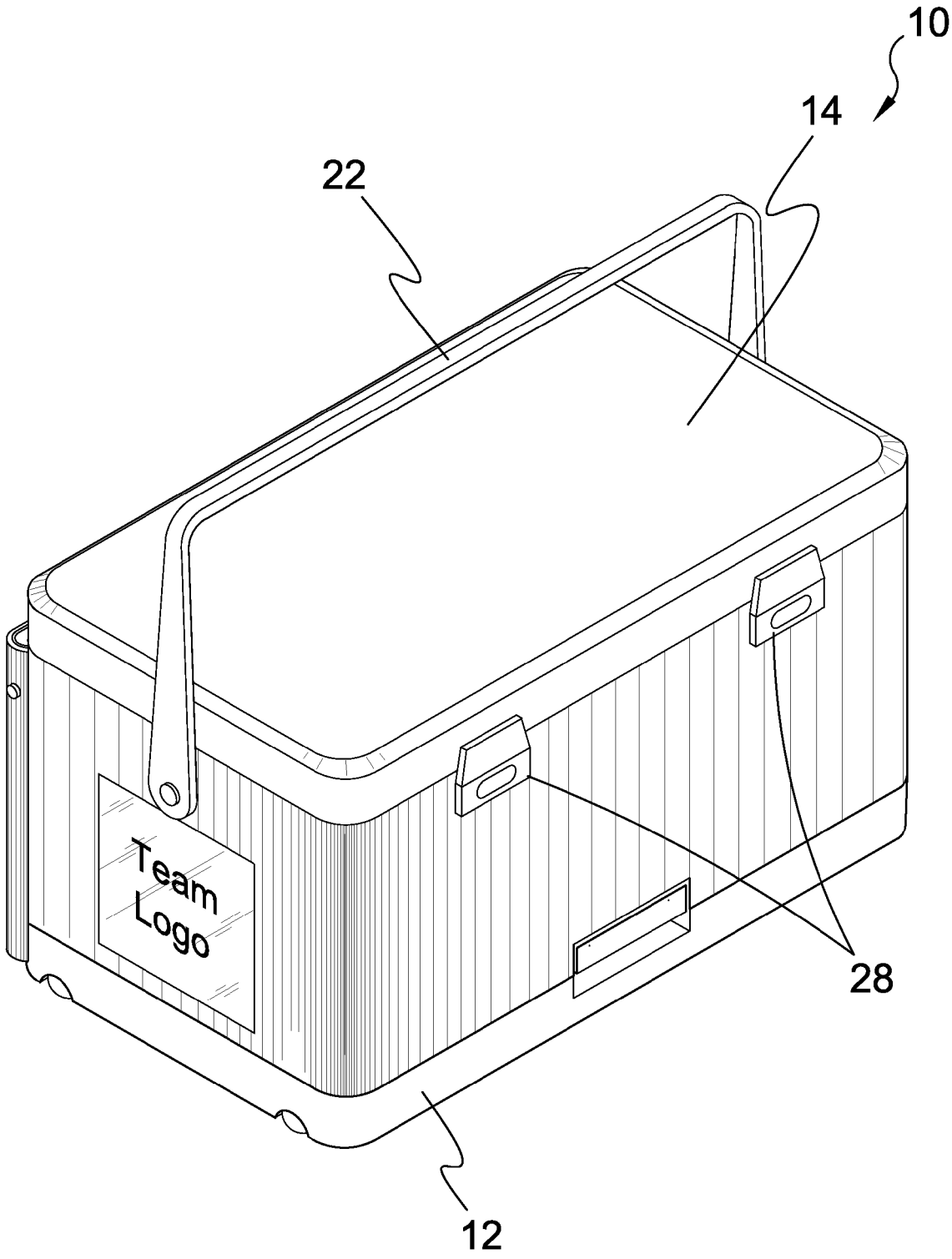
FIG. 4 is a perspective view of the present invention.

FIG. 4 is a perspective view of the present invention 10. Shown is the cooler body 12 with the padded cooler cover seat 14 closed and secured with the cover access locks 28. The swivel handle 22 is in the raised carrying position.

Figure 5:
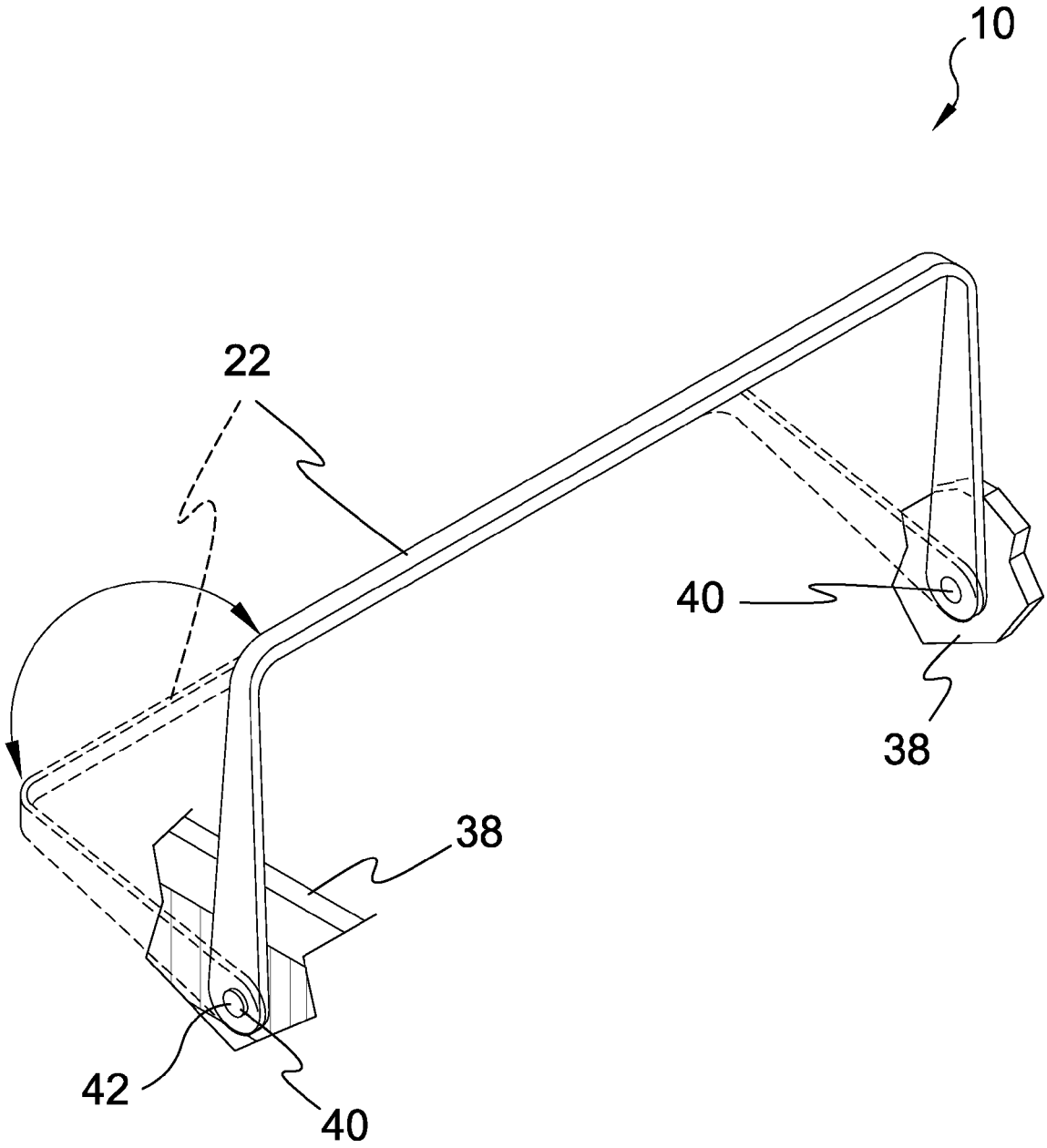
FIG. 5 is a detailed view of the handle of the present invention.

FIG. 5 is a detailed view of the handle 22 of the present invention 10. Shown is the cooler handle 22 rotated to an up or carry position and depicted in dotted line in the lowered, rest position. A lock button 42 located at its pivot point connection 40 to the cooler sidewall 38 allows the handle 22 to secure in both up or carrying position and down or rest position.

Figure 6:
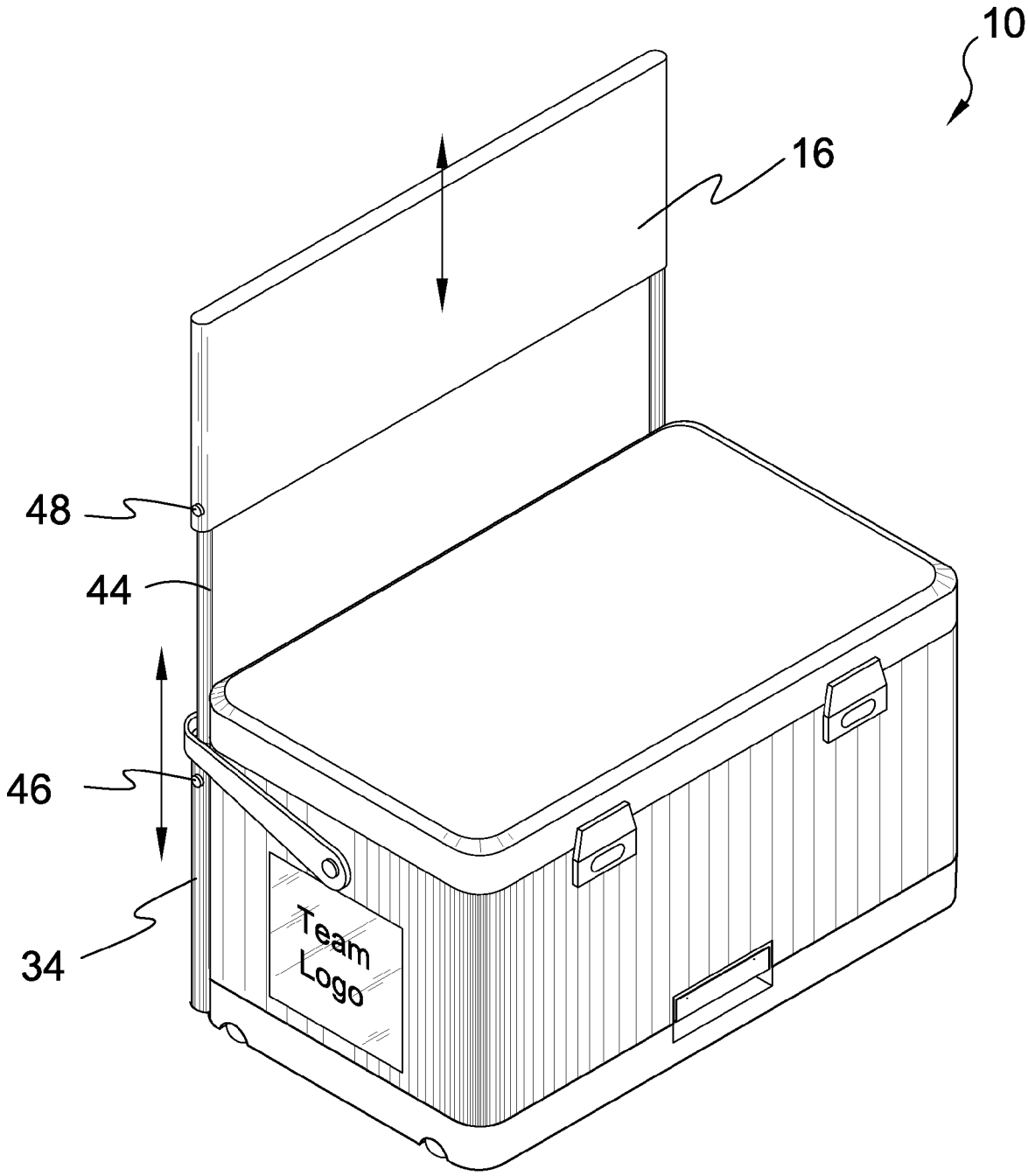
FIG. 6 is a perspective view of the present invention with retractable back support extended.

FIG. 6 is a perspective view of the present invention 10 with retractable back support 16 extended. When not in use the back support 16 resides within a housing 34 and is pulled up therefrom when needed. Telescoping arms 16 extend from the housing 34 when extracted and have an arm release button 46 affiliated with the housing 34 and a back support release button 48 associated with the back support 16.

Figure 7:
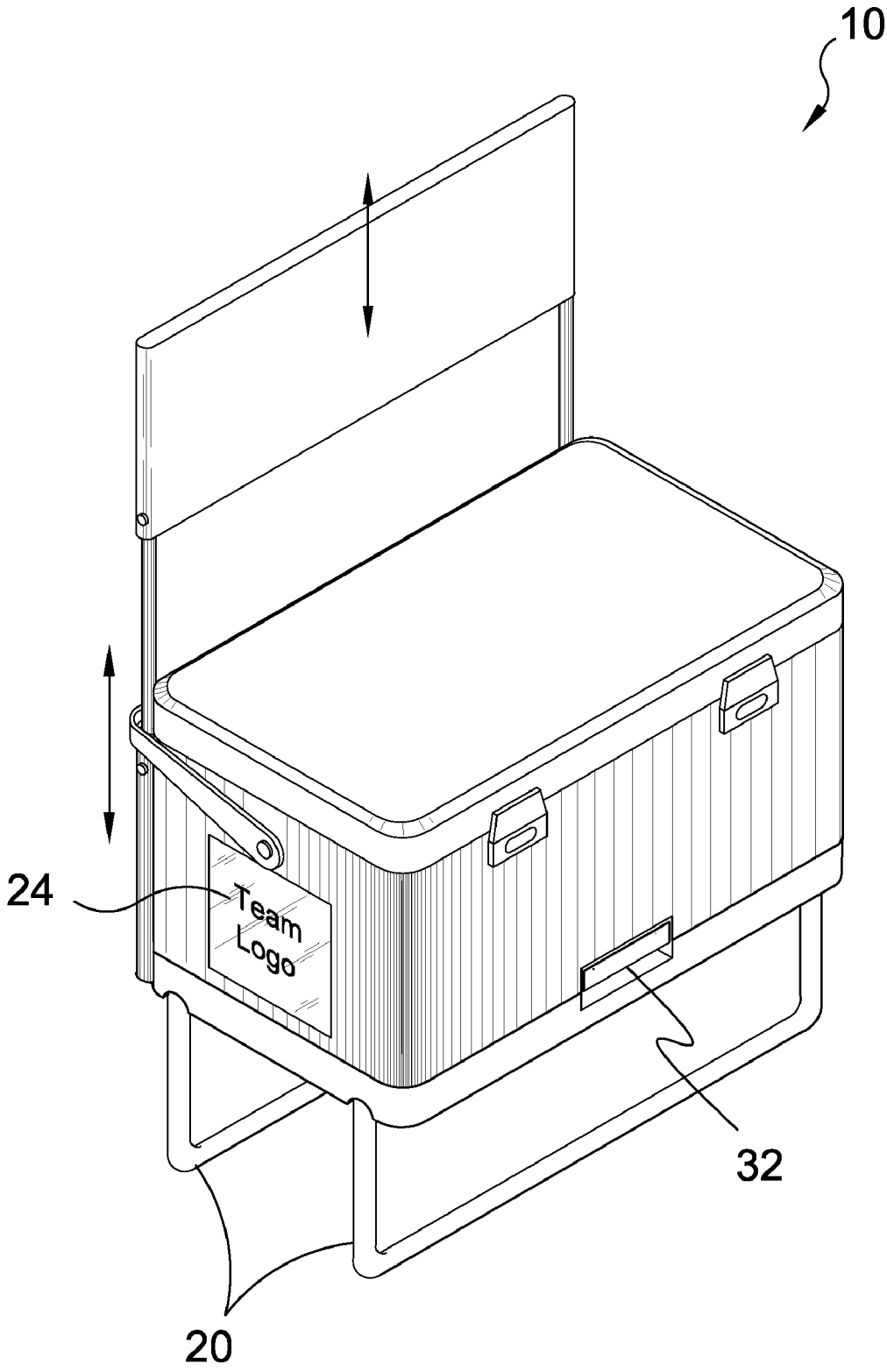
FIG. 7 is a perspective view of the present invention.

FIG. 7 is a perspective view of the present invention 10. The legs 20 are frictionally engaged in the closed position until the release latch 32 is pulled to remove the bias applied to the legs 20 thus allowing them to drop to provide a comfortable height for sitting thereon. Pockets 24 are positioned on each side for placement of a placard of a team logo or other user provided graphic.

Figure 8:
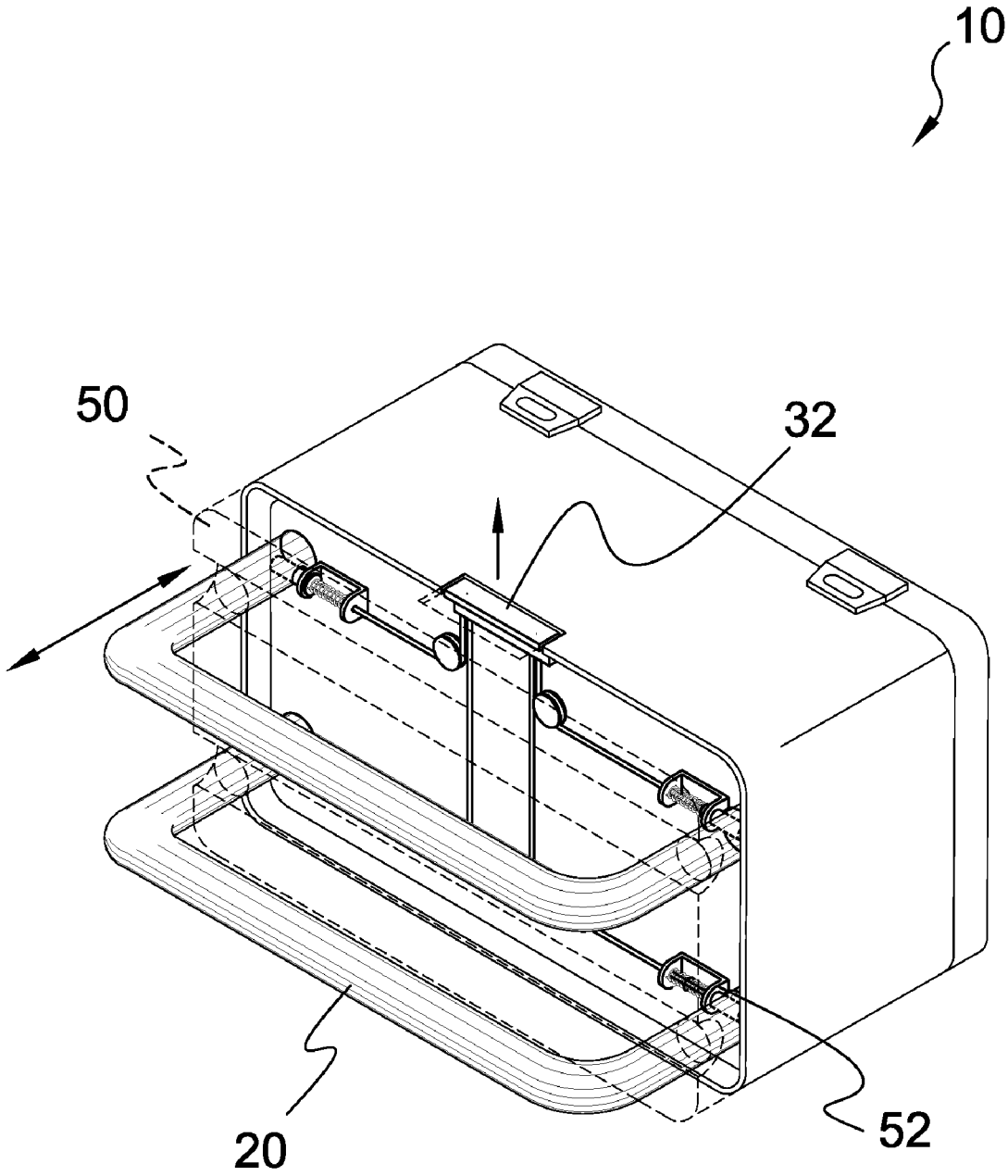
FIG. 8 is a perspective view of the bottom of the cooler of the present invention.

FIG. 8 is a perspective view of the bottom of the cooler of the present invention 10. Shown is the bottom of the cooler of the present invention having releasable legs 20 for supporting a load while in use and retractable for storage. Two recessed areas at the bottom base 50 of the cooler allow the retractable legs 20 to be flush with the bottom of said cooler when retracted. A centralized latch 32 is interconnected to each release assembly 52 to provide means to retract and extend the legs 20.

Figure 9:
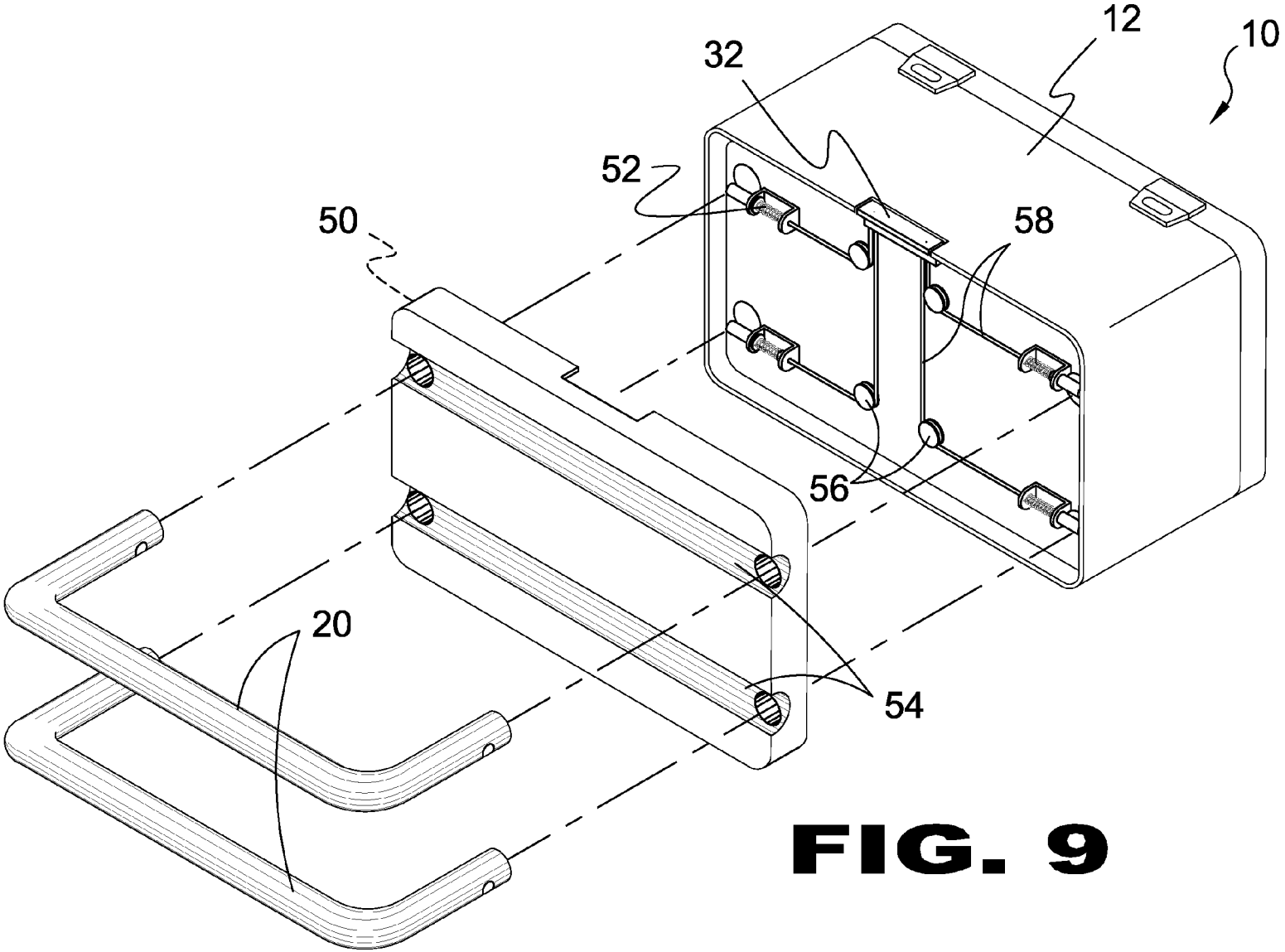
FIG. 9 is an exploded view of the bottom of the cooler of the present invention.

FIG. 9 is an exploded view of the bottom of the cooler of the present invention 10. Two recessed channels 54 at the bottom base 50 of the cooler body 12 allow the retractable legs 20 to be flush with the bottom of said cooler when retracted. A centralized latch 32 is in communication with each release assembly 52 via pulleys 56 and cables 58.

Figure 10:
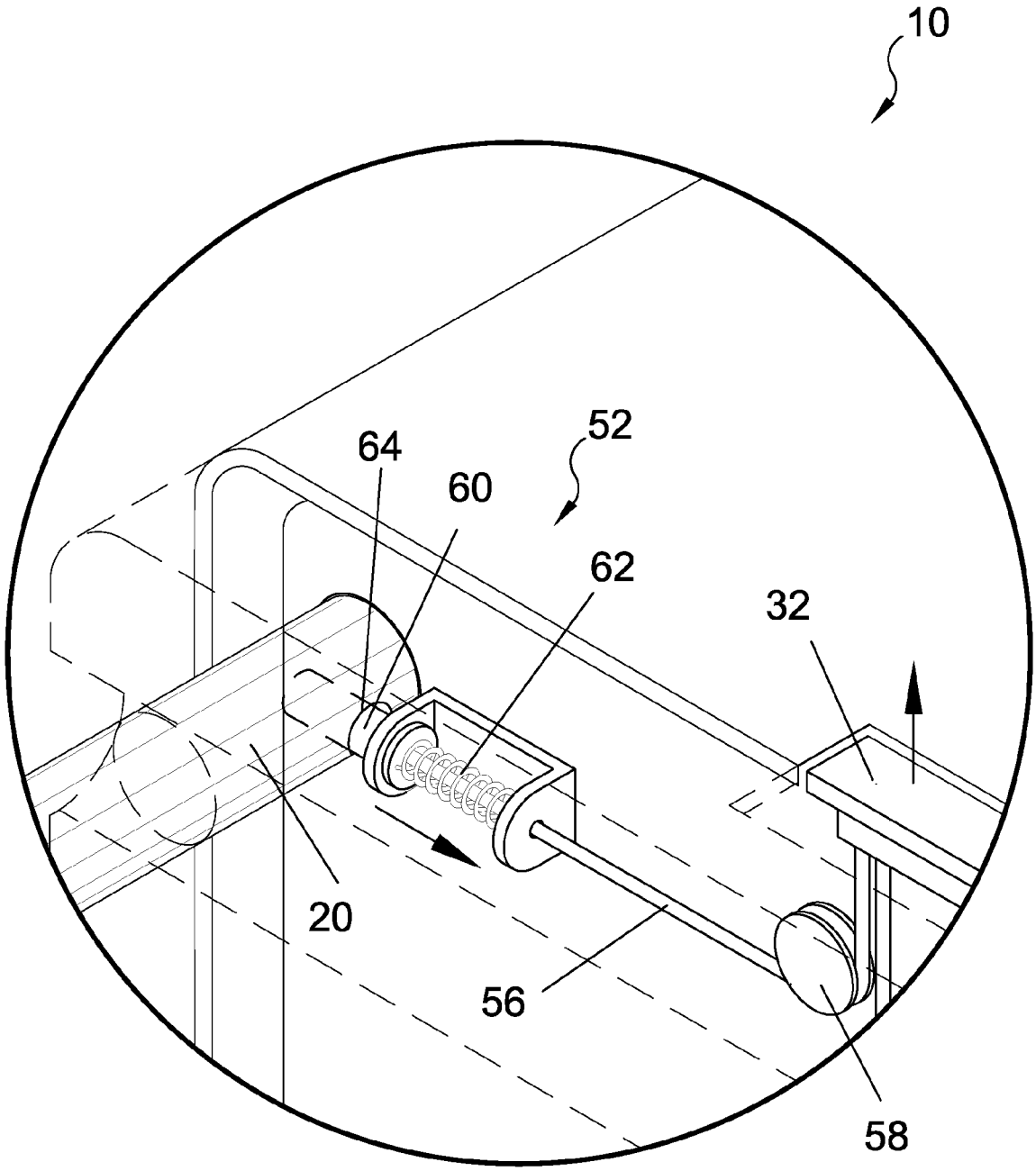
FIG. 10 is a detail view of the leg release assembly of the cooler of the present invention.

FIG. 10 is a detail view of the leg release assembly of the cooler of the present invention 10. A centralized latch 32 is interconnected to each release assembly 52 via pulleys 56 and cables 58 to provide means to retract and extend the legs 20. When the latch 32 is pulled outward, a locking pin 60 is disengaged from a mating aperture 64 disposed in each leg 20. A tension spring 62 allows the pin 60 to re-engage when the latch 32 is released.

Figure 11:
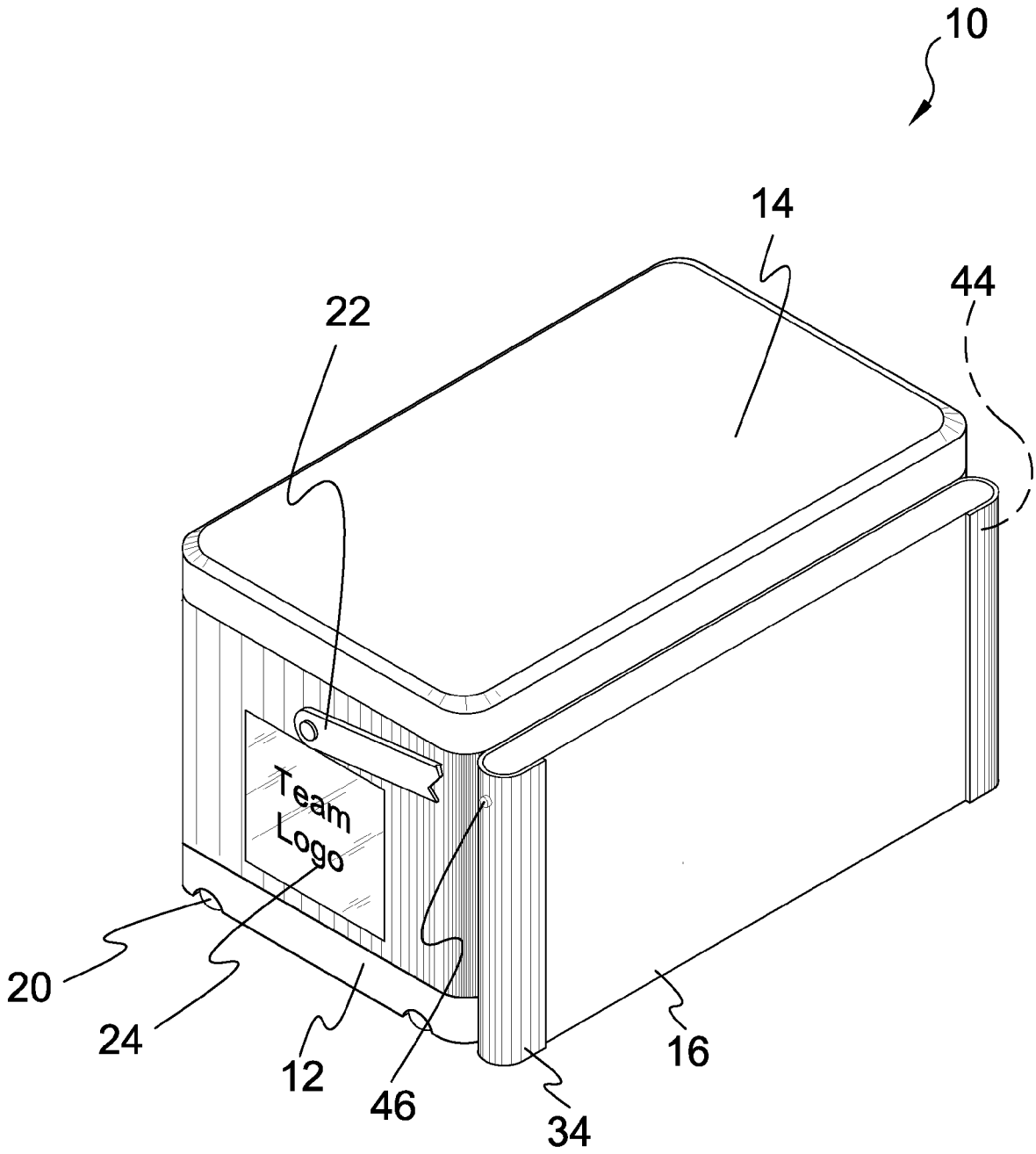
FIG. 11 is a rear view of the cooler seat of the present invention.

FIG. 11 is a rear view of the cooler seat of the present invention. Depicted is a rear view of the portable cooler bench seat 10 comprising cooler body 12, padded cover seat 14, and housing 34 of back support 16 with handle 22 partially removed. Back support 16 comprises housing 34 with release mechanism 46 for maintaining back support 16 in an extended or retracted position. When use of back support 16 is desired, pressure applied to release mechanism 46 allows the back support to extend via telescopic arms 44 to a position where locking element 48 engages holding back support 16 in an extended position. Also shown are legs 20 in a stored position with housing 12 having transparent pocket 24 whereby a user can selectively insert any desired placard therein.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A portable cooler bench seat comprising:

a) a cooler body having a bottom wall and sidewalls depending peripherally therefrom, said bottom wall having a recess to accommodate a base;

b) a hinged, padded cover enclosing a top opening of said cooler body and providing a cushioned seat;

c) an extendible, retractable back support slidable vertically in and out of a a housing mounted on a rear sidewall of said cooler body; and d) a pair of substantially U-shaped legs extending vertically down from openings in a bottom of said recess of said bottom wall, said legs being extendable and retractable; and e) a bottom surface of said base having recessed channels to accommodate horizontal portions of said U-shaped legs whereby when said legs are retracted into said body said horizontal portions of said legs are flush with a bottom of said cooler body.

2. The portable cooler bench seat recited in claim 1, wherein said back support is supported by a pair of spaced apart telescoping arms when in use.

3. The portable cooler bench seat recited in claim 2, wherein said telescoping arms are retained in the raised position by arm release buttons integral with said housing and said back support is maintained in the raised position by back support release buttons related with said arms.

4. The portable cooler bench seat recited in claim 3, wherein said telescoping arms recede into said housing and into said back support during storage.

5. The portable cooler bench seat recited in claim 4, wherein said legs are frictionally engaged in a stored position by a plurality of release assemblies disposed in the recess of said bottom wall between said base and bottom wall of said cooler body.

6. The portable cooler bench seat recited in claim 5, wherein said cooler body has a release latch in communication with said release assemblies via pulleys and cables.

7. The portable cooler bench seat recited in claim 6, wherein activation of said release latch removes the frictional engagement of said legs thereby enabling them to drop to the extended position.

8. The portable cooler bench seat recited in claim 7, wherein said release assemblies comprise a bracket with a tension spring providing a bias urging a locking pin outward towards said legs until said bias is overcome by pulling said release latch and the cables associated with each locking pin.

9. The portable cooler bench seat recited in claim 8, wherein said legs have locking apertures disposed therein for receiving said locking pins when in the fully extended position.

10. The portable cooler bench seat recited in claim 1, further comprising at least one transparent plastic pocket for retaining an item containing indicia or graphic design.

11. A portable cooler bench seat comprising:

a) a cooler body having a base and sidewalls depending therefrom;

b) a hinged cover having a cushioned top surface;

c) a pair of spaced apart, substantially U-shaped legs that are stored within said cooler body when not in use and are extended vertically downwardly from said cooler body for use of said cooler body as a seat;

d) a release latch in communication with a plurality of release assemblies for retaining said legs in the extended and retracted positions, said release assemblies being enclosed in a bottom recess of said cooler body and covered by a base;

e) an extendible back support that is stored in a housing disposed in the rear of said cooler body when not in use; and f) a pair of spaced apart telescoping arms for retaining said back support in the raised position and locked therein via arm release buttons integral with said housing and back support release buttons communicating with the top of said arms and with said back support.

12. The portable cooler bench seat recited in claim 11, further comprising a swivel handle secured to opposing sides of said cooler body at pivot points having a lock button to secure said handle in the raised carrying position and the lowered resting position.

* * * * *